US005256352A

United States Patent [19]

Snyder et al.

[11] Patent Number: 5,256,352

[45] Date of Patent: Oct. 26, 1993

[54] AIR-LIQUID MIXER

[75] Inventors: Timothy S. Snyder, Glastonbury; Bruce V. Johnson, Manchester, both of Conn.

[73] Assignee: United Technologies Corporation, Hartford, Conn.

[21] Appl. No.: 939,275

[22] Filed: Sep. 2, 1992

[51] Int. Cl.[5] ..... B05B 7/08

[52] U.S. Cl. ..... 261/78.2; 239/424.5; 239/433; 60/737

[58] Field of Search ..... 261/78.2; 239/424.5, 239/433; 60/737

[56] References Cited

U.S. PATENT DOCUMENTS

| | | | |
|---|---|---|---|
| 2,942,655 | 6/1960 | Taylor | 239/424.5 |
| 2,965,303 | 12/1960 | Jackson | 239/424.5 |
| 3,121,457 | 2/1964 | Whipple et al. | 239/424.5 |
| 3,360,201 | 12/1967 | Popyk | 239/424.5 |
| 4,012,904 | 3/1977 | Nogle | 60/737 |
| 4,081,958 | 4/1978 | Schelp | 60/737 |
| 4,116,383 | 9/1978 | Johnson | 239/8 |
| 4,278,418 | 7/1981 | Strenkert | 239/424.5 |
| 4,584,834 | 4/1986 | Koshoffer et al. | 60/737 |
| 4,653,278 | 3/1987 | Vinson et al. | 60/737 |
| 4,773,596 | 9/1988 | Wright et al. | 239/424.5 |

FOREIGN PATENT DOCUMENTS

| | | | |
|---|---|---|---|
| 2364556 | 7/1975 | Fed. Rep. of Germany | 239/424.5 |
| 2910464 | 9/1979 | Fed. Rep. of Germany | 239/424.5 |
| 793325 | 4/1958 | United Kingdom | 60/737 |

OTHER PUBLICATIONS

T. S. Snyder, J. B. McVey, B. J. Lazaro; Characterization of Fuel Injector Spray Homogeneity for $NO_x$ Reduction First International Conference On Combustion Technologies for a Clean Environment; Sep. 3-6 1991.

*Primary Examiner*—Tim Miles

*Attorney, Agent, or Firm*—Troxell K. Snyder

[57] ABSTRACT

An impinging jet mixer 40 includes a central atomizer 42 for providing a conical fuel stream 50 and means 56, 58 for providing a plurality of intersecting gas jets 62, 66 which meet the conical fuel spray 50 at an interaction zone 64 spaced downstream of the atomizer discharge opening 70.

1 Claim, 6 Drawing Sheets

AIR-LIQUID MIXER

FIELD OF THE INVENTION

The present invention relates to a device for rapidly mixing a flow of liquid and a flow of gas.

BACKGROUND

Devices or nozzles for intermingling a flow of liquid and a flow of gas are well known. Such mixers may combine a variety of liquids and gasses, but all have the common goal of producing a uniform dispersion of the liquid component throughout the gaseous component.

One particular application in which achieving rapid uniformity of the mixture is especially critical is in the combustor section of a gas turbine engine or the like. In a gas turbine engine combustor, liquid fuel is reacted with air to produce an elevated temperature working fluid which enters a downstream turbine section of the engine. Due to size and weight constraints, the volume of the combustor section of a gas turbine engine is limited in size. As it is necessary that the combustion reaction be substantially completed before the combustion products enter the turbine section, combustor designers have long attempted to increase the rapidity of the mixing of the liquid fuel and air prior to initiation of the combustion reaction.

The accepted method of enhancing the mixing of fuel and air is through increased shear, general turbulence, etc. Shear is generated in the prior art by swirling the air injected with the fuel.

In recent years, awareness of environmental concerns have prompted designers to investigate different methods for reducing the generation of pollutants by gas turbine engines. One pollutant, nitrous oxide, is best controlled by achieving a well mixed, uniform dispersion of the liquid fuel with the combustor air prior to initiation of the combustion reaction. By avoiding pockets or other non-uniform variations of the mixture stoichiometry within the combustor zone, the combustor designer may control the peak combustor temperatures below the levels which might result in the generation of significant nitrous oxide pollutants.

DISCLOSURE OF THE INVENTION

The present invention provides a device for rapidly mixing a flow of liquid and a flow of gas in order to achieve a substantially uniform distribution of the liquid in the gas flow. The device generates a maximum amount of turbulence adjacent the liquid discharge by means of a plurality of intersecting gas jets and liquid streams.

The gas jets and liquid streams, according to an embodiment of the present invention, intersect angularly, resulting in the generation of intense local vorticity without the requirement of an overall swirling of the mixed liquid and gas flows. The local vorticity enhances the dispersion of the liquid flow while avoiding the centrifugal separation which is inherently produced by the overall swirling flow of the prior art.

According to an embodiment of the present invention, a central liquid discharge nozzle provides a conical spray of liquid having an enlarging diameter down stream along the device centerline. A first plurality of gas discharge openings, disposed circumferentially about the centerline and surrounding the liquid discharge nozzle, provides a plurality of gas jets flowing generally parallel with the centerline and intersecting the liquid spray cone within a torroidal interaction region. The device includes a second plurality of gas discharge openings, disposed radially outward of the first plurality of gas jets and angled to as to discharge a second plurality of gas jets into the interaction region at an acute angle with respect to the flow of gas from the first plurality of gas jets.

The intersecting gas jets and liquid spray cone, according to the present invention, induces a rapid mixing of the discharged liquid and air resulting in a substantially homogenous mixture of the liquid and gas flow within a short distance from the mixing device. Because there is little or no swirl in the fuel-air mixture, the liquid fuel is not centrifugally separated from the gas phase. The resulting mixture can thus achieve a greater homogeneity than the prior art mixers.

DETAILED DESCRIPTION

Figure 1:
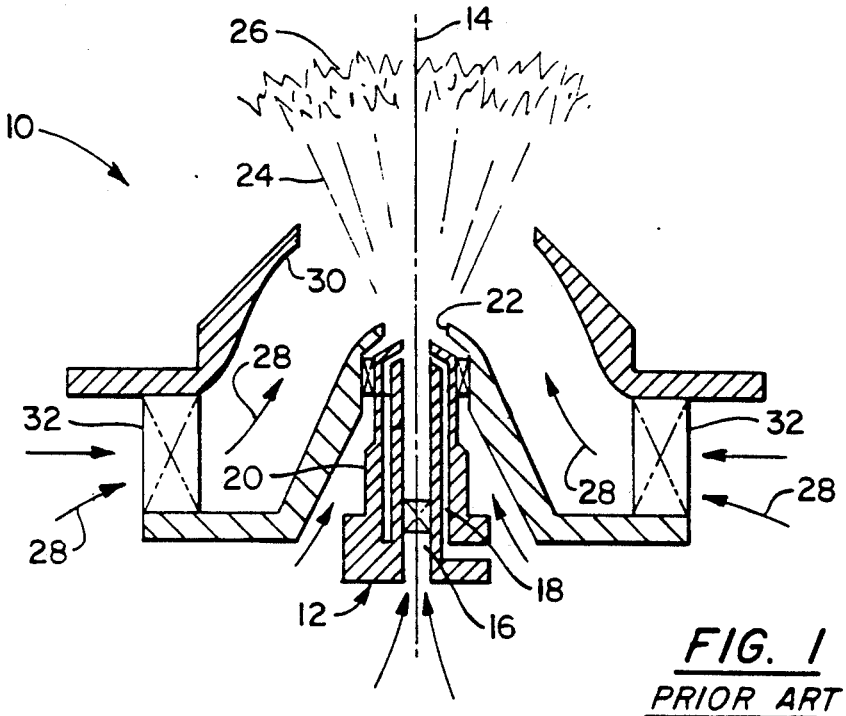
FIG. 1 PRIOR ART
FIG. 1 shows a prior art swirling mixer in cross-section.

Referring to the drawing figures, and in particular to FIG. 1, a prior art radially swirling mixer 10 is shown in cross-section. The prior art swirler-mixer 10 includes an atomizer 12 disposed along the centerline 14 and having an axially central airflow passage 16 for discharging a central primary air stream along the centerline 14, a surrounding annular fuel conduit 18 and a concentric outer annular primary airflow passage 20. Liquid fuel flowing through the conduit 18 exits the atomizer nozzle 22 wherein it encounters a central primary airflow exiting the central passage 16 and a surrounding annular primary airflow exiting the annular passage 20. The combination of the primary airflows in the passages 16, 20 and the fuel discharged from the fuel passage 18 is a conical spray of fuel droplets 24 which enters the combustion zone 26 of, for example, a gas turbine engine (not shown).

As will be familiar with those skilled in the art, the combustion of fuel within a gas turbine engine requires careful control of the mixing ratio of the fuel and air prior to ignition of the mixture. The air supplied via passages 16 and 20 in the mixer 40 function to disperse the liquid fuel stream exiting passage 18, but is insufficient to initiate and stabilize the combustion of the discharged fuel 24. Hence, a flow of secondary air enters the combustion zone 26 via a concentric secondary air passage 30. A swirler-mixer according to prior art enhances the mixing of the secondary air 28 and the fuel droplet discharge 24 by introduction of a large swirl component in the secondary air 28 through the use of swirling vanes 32.

Figure 2:
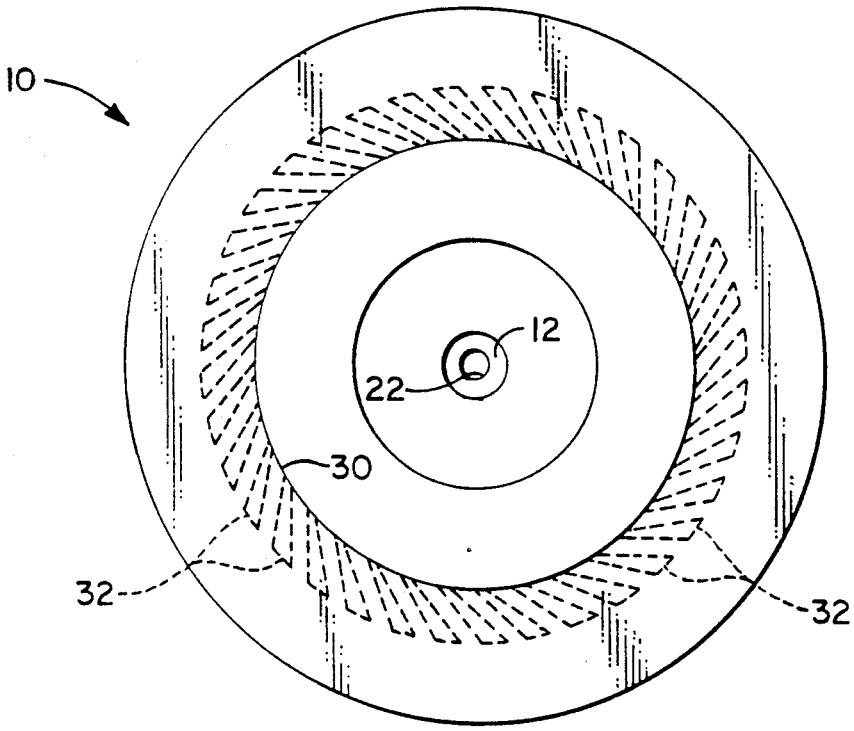
FIG. 2 PRIOR ART
FIG. 2 shows a top view of the mixer in FIG. 1.

The swirl vanes 32, shown in phantom in FIG. 2, impart a tangential velocity to the secondary airflow 28 increasing the turbulence at the discharge of the secondary air passage 30. While effective in increasing the turbulence in the prior art mixer 10, this high collective swirl can result in varying concentration of the fuel and air mixture within the combustion zone 26. As noted hereinabove, such variations may lead to increased generation of undesirable pollutants, such as nitrous oxide. The swirling secondary airflow may, under certain circumstances, serve to increase this non homogeneity by causing the heavier liquid fuel droplets to be thrown outward, away from the centerline 14, thus resulting in local regions of fuel rich and overly fuel lean mixtures within the zone 26.

Figure 3:
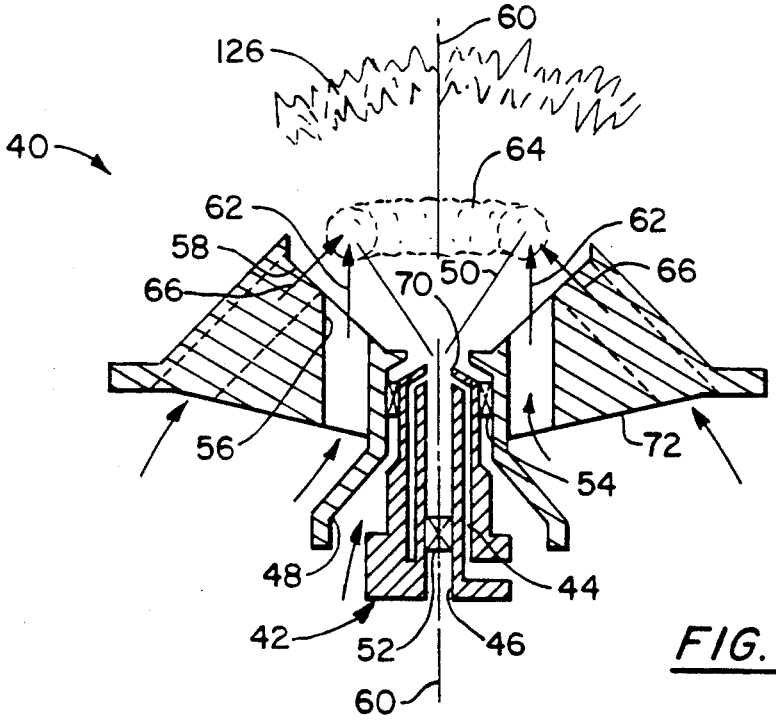
FIG. 3 shows a cross-sectional view of a mixer according to the present invention.

FIG. 3 shows an impinging jet mixer 40 according to the present invention. The mixer 40 includes a central atomizer 42 receiving a flow of liquid fuel in an annular conduit 44 and atomizing such fuel by a central primary flow of air exiting a central primary flow conduit 46 and an annular, surrounding flow of primary air exiting annular conduit 48. As in the prior art, the interaction of the fuel and primary air exiting conduits 44, 46 and 48 results in a conical spray discharge 50 of dispersed atomized liquid fuel. The embodiment 40 of the present invention, as in the prior art, may include swirl imparting devices 52, 54 disposed in the central and surrounding primary airflow passages 46, 48 in order to provide a stable and well atomized conical spray 50. Although shown as an airblast type atomizer in the embodiment of FIGS. 3 and 4, it will be understood by those skilled in the art that the liquid discharge means 42 may be any one of a variety of liquid spray nozzles which are capable of discharging a conical spray 50.

The mixer according to the present invention 40 includes secondary airflow discharging means in the form of discharge openings 56 and 58. The first plurality of discharge openings 56 are disposed circumferentially about the atomizer 42 and are aligned so as to discharge a jet of air 62 parallel to the atomizer centerline 60. Each of the first plurality of secondary airflow discharge openings 56 discharges a jet of secondary air 62 which intersects the conical fuel spray 50 within a torroidal interaction zone 64 which is spaced down stream of the atomizer discharge opening 70. A further portion of the secondary air is discharged from the second plurality of discharge openings 58 which are disposed circumferentially about the centerline 60 and which surround the first secondary airflow passages 56. The outer secondary airflow passages 58 each discharge a second jet 66 of secondary air. Each second jet of secondary air 66 encounters the conical fuel spray 50 and the first secondary air jets 62 within the torroidal interaction zone 64.

Thus, the interaction zone 64 in the embodiment 40 according to the present invention is the torroidal volume in which the flow of dispersed fuel 50 and first and second secondary air jets 62, 66 encounter each other. The intense turbulent mixing which occurs within the interaction zone 64 rapidly disperses and intermingles the fuel droplets 50 and the airflows 62, 66 thereby achieving a homogenous fuel air mixture prior to entering the combustion zone 126. As will be appreciated by those skilled in the art, there is no collective swirl imparted to the overall mixture of fuel and air by the interacting secondary air jets 62. 66, thus there is no centrifugal force component which might serve to accelerate the fuel droplets outward from the mixer centerline 60 as has been known to occur in prior art mixers.

Figure 4:
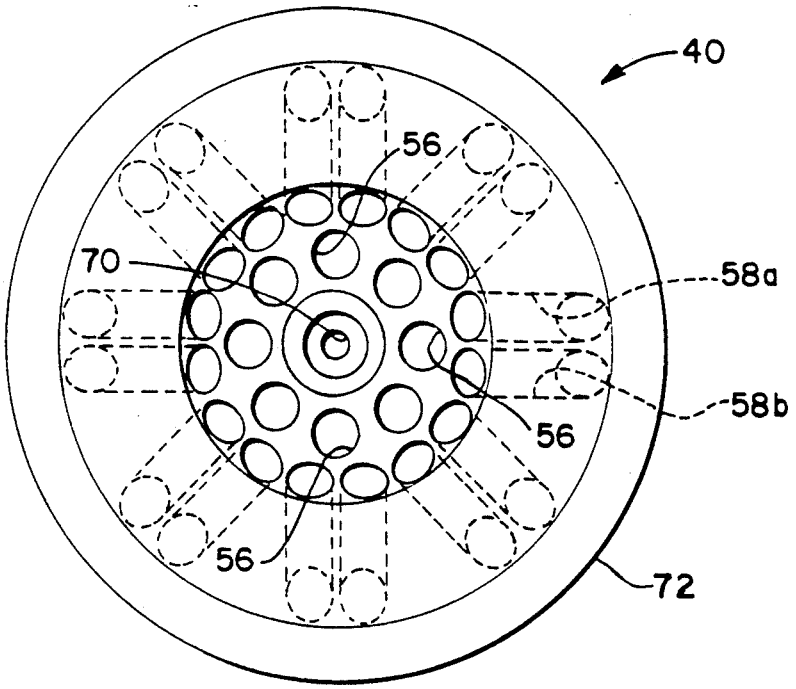
FIG. 4 shows a top view of the mixer of FIG. 3.

It must be observed that the outer secondary airflow passages 58 are shown in FIG. 4 as circumferentially distributed pairs 58A, 58B of passages having circular cross-sections. It has been observed through testing that a single passage is equally effective as long as such single passage discharges the second portion of the secondary airflow into the conical fuel spray 50 at the torroidal interaction zone 64 while simultaneously encountering the first secondary air jet 62. The double passages 58A, 58B shown in the embodiment 40, and most clearly in FIG. 4, are a machining convenience wherein a simple drill or other cutting member may be used to provide the passages 58A, 58B in a surrounding housing body 72.

Figure 5:
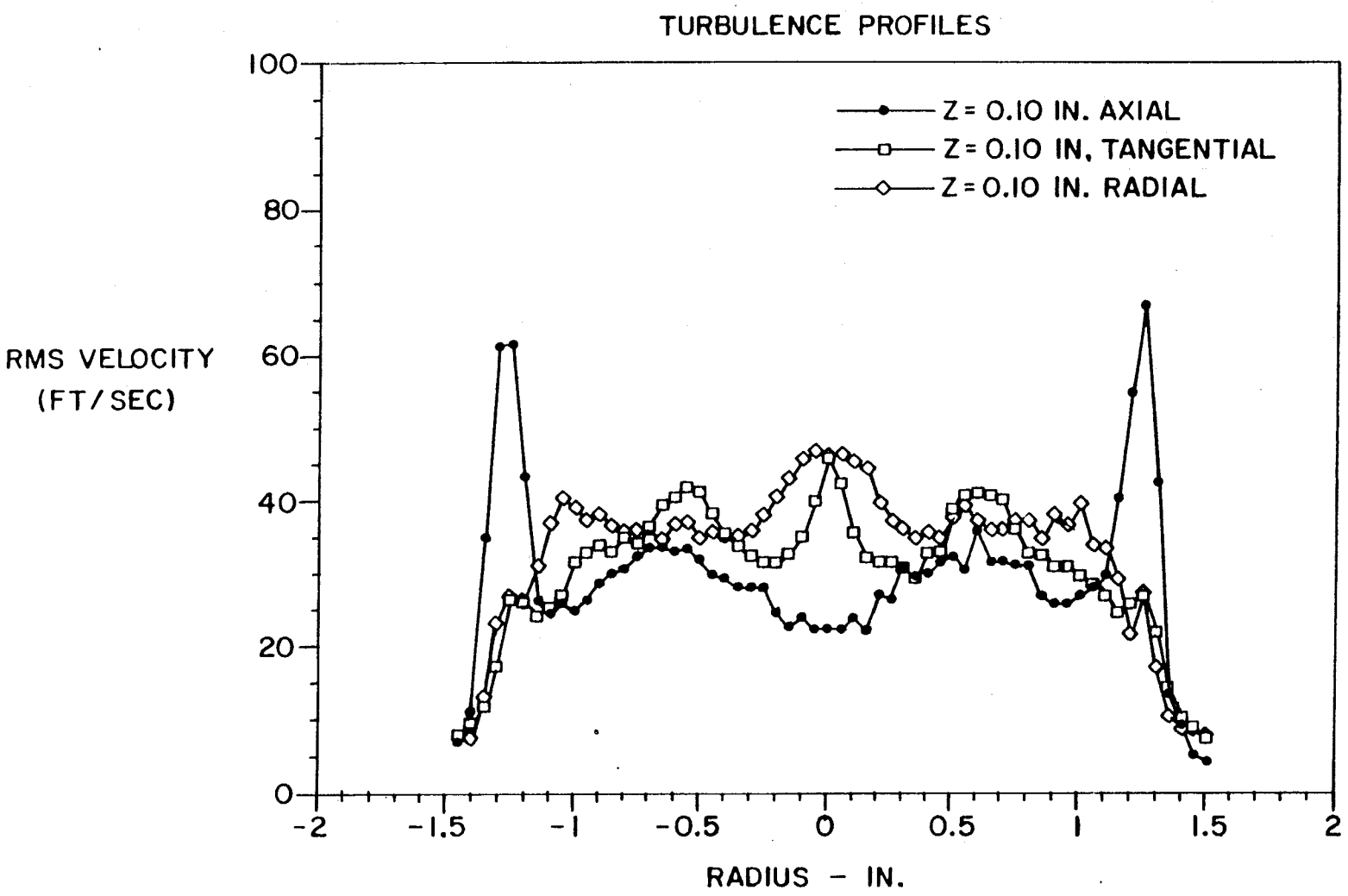
FIG. 5 is a plot of turbulence profiles versus radius for a mixer according to the present invention.
Figure 6:
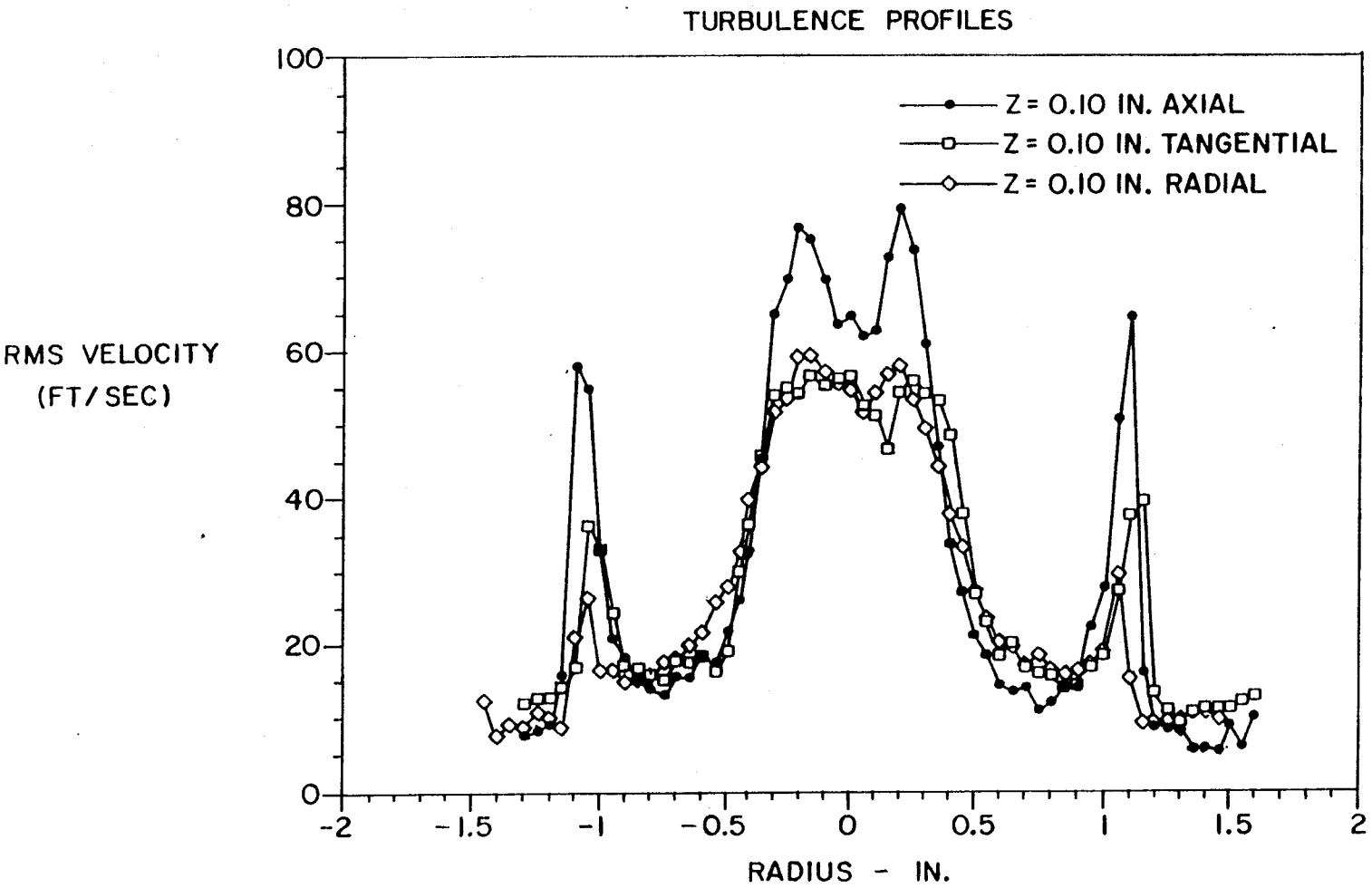
FIG. 6 PRIOR ART
FIG. 6 is a plot of turbulence profiles versus radius for a prior art mixer.
Figure 7:
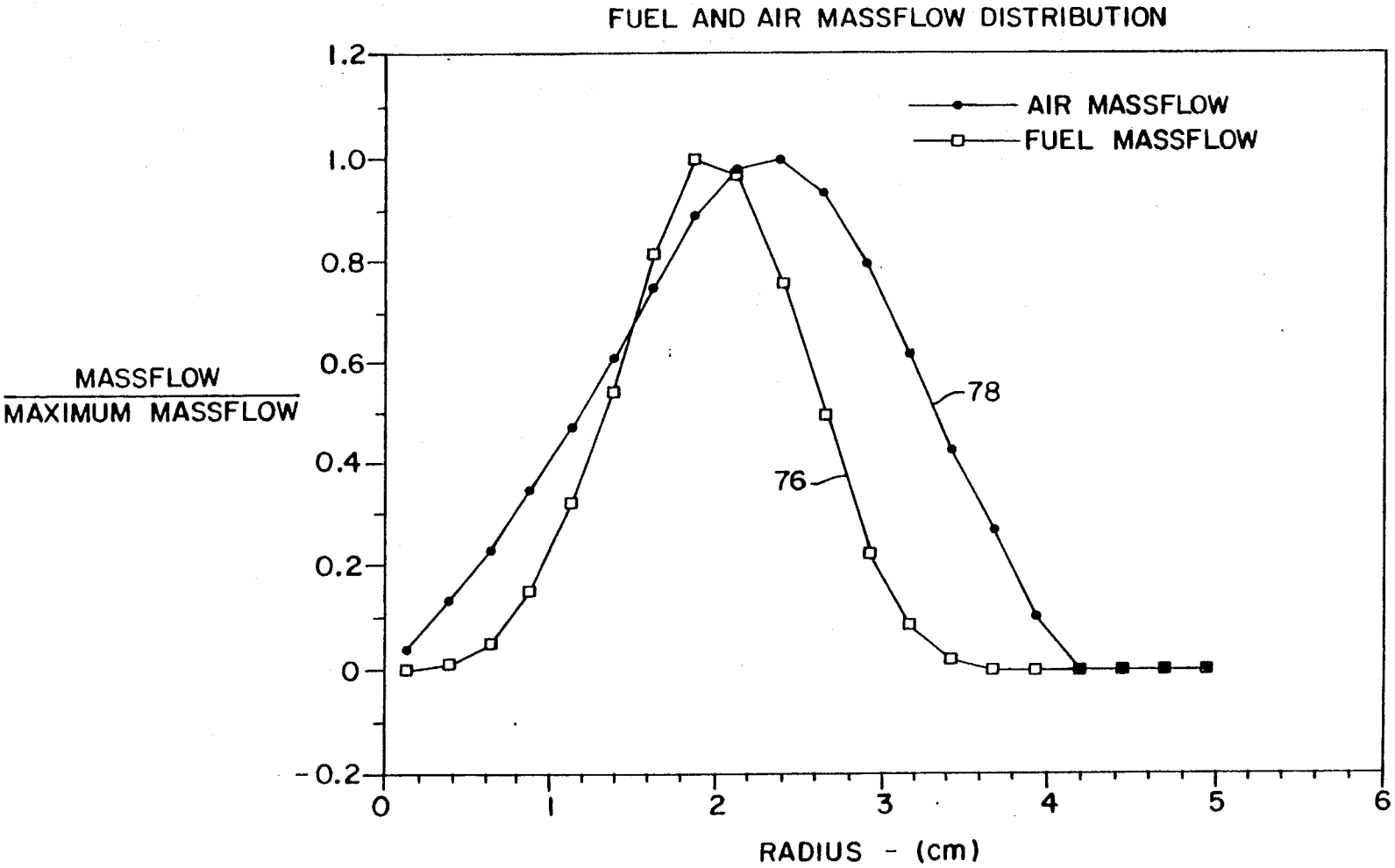
FIG. 7 is a plot of the fuel and air mass flow distribution for a mixer according to the present invention.
Figure 8:
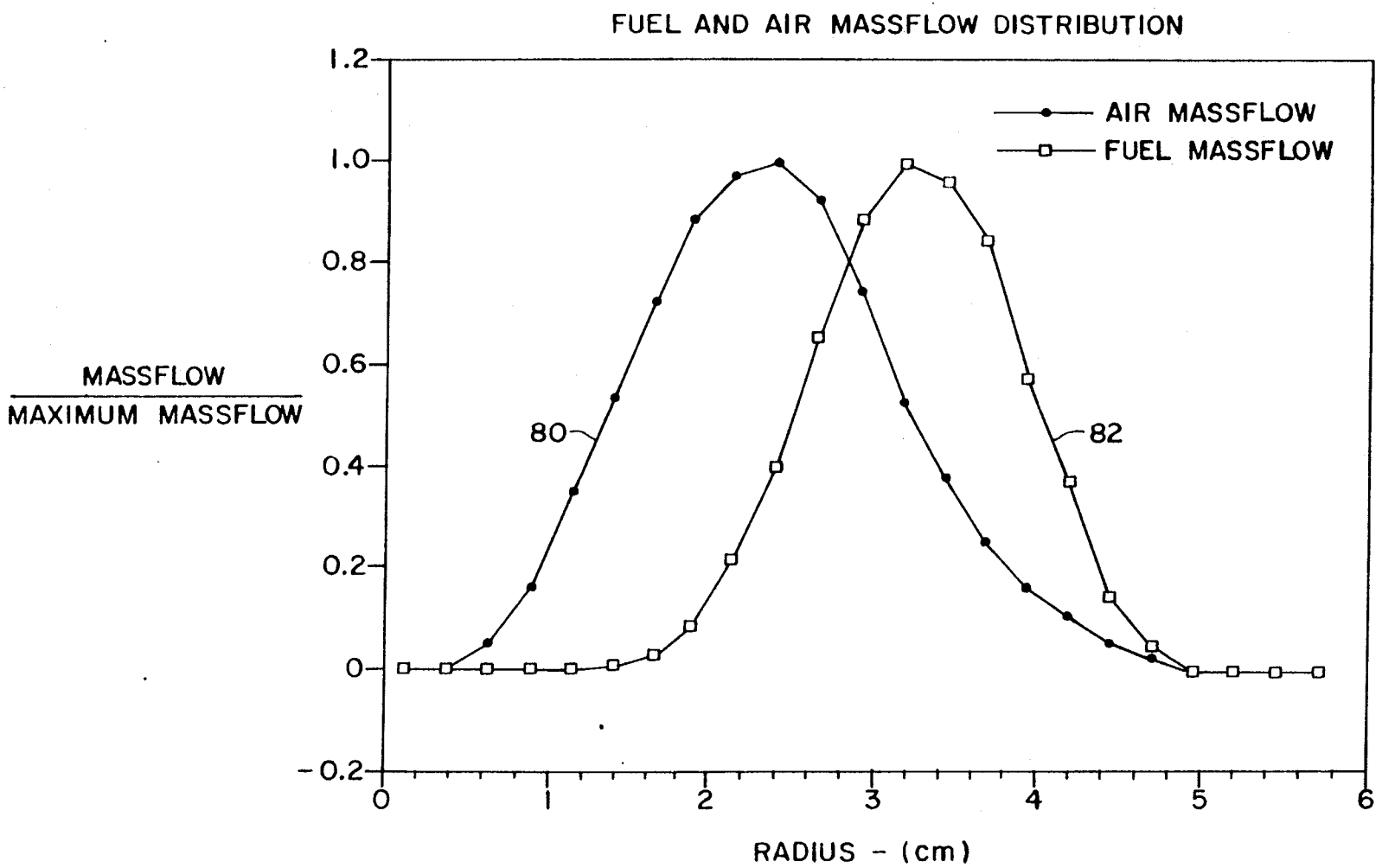
FIG. 8 PRIOR ART
FIG. 8 is a plot of the fuel and air mass flow distribution for a prior art mixer.

Improved performance of an impinging jet mixer 40 according to the present invention is illustrated by FIGS. 5–8. FIG. 5 shows the turbulence profiles in the axial, tangential and radial direction at a point immediately downstream of the atomizer in the mixer 40. As may be observed from FIG. 5, the turbulence profile is relatively evenly distributed radially in the three measured directions. This may be contrasted with the turbulence profiles in FIG. 6 measured at an equivalent point in the prior art swirler nozzle 10 which show wide variation with radial displacement. FIG. 7 illustrates the proportional distribution of the air and fuel mass with respect to radial displacement from the centerline 60 of the mixer 40 according to the present invention. As may be observed, the fuel distribution 76 is relatively closely aligned to the air distribution curve 78. This FIG. 7 is to be contrasted with FIG. 8 illustrating the same distribution of fuel and air for the prior art mixer 10 wherein the air distribution 80 is shown widely displaced from the fuel curve 82.

We claim:

1. A device for mixing a flow of liquid with a flow of gas, comprising means for discharging the liquid into a mixing region as a downstream expanding, conical spray having a centerline;

first means for discharging a first portion of the flow of gas into the mixing region, said first gas discharging means including a first plurality of discharge outlets, disposed circumferentially about the centerline and surrounding the liquid discharge means, each of said first plurality of outlets oriented to discharge a corresponding first jet of gas axially into the conical spray within a torroidal interaction zone spaced downstream from the liquid discharge means; and second means for discharging a second portion of the flow of gas into the mixing region, said second air discharge means including a second plurality of discharge outlets disposed circumferentially about the centerline and surrounding both the liquid discharge means and the first gas discharge means, each of said second plurality of outlets oriented to discharge a second jet of gas into the conical spray within the torroidal interaction zone, wherein each second jet of gas intersects a corresponding first jet of gas at an acute angle, the point of intersection of the first and second jets of gas being coincident with the conical spray and located within the torroidal interaction zone.

* * * * *